US010518436B2

(12) United States Patent
Ljung

(10) Patent No.: US 10,518,436 B2
(45) Date of Patent: Dec. 31, 2019

(54) FEEDING DEVICE FOR AXIAL FEEDING OF LOGS

(71) Applicant: Söderhamn Eriksson AB, Söderhamn (SE)

(72) Inventor: Jonas Ljung, Norrala (SE)

(73) Assignee: Söderhamn Eriksson AB, Söderhamn (SE)

( * ) Notice: Subject to any disclaimer, the term of this patent is extended or adjusted under 35 U.S.C. 154(b) by 736 days.

(21) Appl. No.: 14/975,033

(22) Filed: Dec. 18, 2015

(65) Prior Publication Data

US 2017/0173815 A1 Jun. 22, 2017

(51) Int. Cl.
*B27L 1/08* (2006.01)

(52) U.S. Cl.
CPC ..... *B27L 1/08* (2013.01)

(58) Field of Classification Search
CPC . B27L 1/04; B27L 1/045; B27B 29/00; B27B 29/04; B27B 29/08; B27B 25/00; B27B 25/02; B27B 25/06; B27B 25/08; B27B 31/00; B27B 31/003
USPC ..... 144/4.1, 242.1, 246.1, 246.2, 247, 248, 144/248.2, 248.3, 248.4, 248.5, 248.6, 2; 198/608, 624
See application file for complete search history.

(56) References Cited

U.S. PATENT DOCUMENTS 2,785,715 A * 3/1957 Brundell ..... B27L 1/045 144/208.8
2,857,945 A 10/1958 Brundell et al.
2,860,672 A * 11/1958 Brundell ..... B27L 1/045 144/208.8
3,147,781 A * 9/1964 Hassell ..... B27B 25/02 144/208.1
3,490,665 A * 1/1970 Jonsson ..... B27B 25/02 144/208.8

(Continued)

FOREIGN PATENT DOCUMENTS

EP 2960026 A1 12/2015
JP 401104307 7/1989

(Continued)

OTHER PUBLICATIONS

European Patent Application No. 15173154.4 extended European Search Report dated Nov. 4, 2015, 6 pages.

(Continued)

*Primary Examiner* — Matthew Katcoff
(74) *Attorney, Agent, or Firm* — Schwabe Williamson & Wyatt, P.C.

(57) ABSTRACT

In various embodiments, a feeding device may comprise a support having feed cylinders arranged in a free end of a respective supporting arm and driven in rotation, wherein the supporting arms in a supported end are journalled in the support on shafts extending in parallel with each other and are pivotable about the shafts between a home position and a pivoted work position, and wherein the supporting arms are mutually connected to each other via a system of articulated links and by means of the links are forced to pivot jointly about their respective shafts, and a movement damping element, which is separate from the support, is integrated in the system of links and independently from the support configured to brake the return movement of the supporting arms from the pivoted position.

23 Claims, 2 Drawing Sheets

(56) References Cited

U.S. PATENT DOCUMENTS

| | | | | | |
|---|---|---|---|---|---|
| 3,596,690 | A * | 8/1971 | Hamilton | A01G 23/097 | 144/24.13 |
| 4,425,952 | A * | 1/1984 | Pousette | B27L 1/045 | 144/248.5 |
| 4,566,585 | A * | 1/1986 | Dreher | G01N 27/9026 | 198/624 |
| 4,609,020 | A * | 9/1986 | Hutson | B27L 1/04 | 144/208.8 |
| 4,643,236 | A * | 2/1987 | O'Brien, Jr. | B27L 1/045 | 144/208.8 |
| 8,935,840 | B2 * | 1/2015 | Mitchell | B27B 31/00 | 144/248.5 |

FOREIGN PATENT DOCUMENTS

| | | | |
|---|---|---|---|
| SE | 517517 | C2 | 6/2002 |
| SE | 1450780 | A1 | 12/2015 |
| SU | 735398 | A1 | 5/1980 |

OTHER PUBLICATIONS

Canadian Patent Application No. 2,915,848 Office Action dated May 18, 2016, 4 pages.

* cited by examiner

FEEDING DEVICE FOR AXIAL FEEDING OF LOGS

TECHNICAL FIELD

Embodiments herein relate to the field of log processing, and, more specifically, to feeding devices configured for feeding a log axially (in the length direction of the log), as well as corresponding methods and systems.

BACKGROUND

One known type of feeding device comprises a support having a through opening and feed cylinders adjoining the opening, which feed cylinders are angularly distributed and which are individually arranged in a free end of a respective supporting arm and driven in rotation, and wherein the supporting arms in a supported end are journalled in the support on shafts extending in parallel with each other and pivotable about the shafts between a home position and a pivoted work position, and wherein the supporting arms are mutually connected to each other via a system of articulated links and by means of the links forced to pivot jointly about their respective shafts.

Feeding devices of this type are used in barking machines of rotation ring type of the kind comprising a stationary machine support and a rotor rotatably journalled in relation to the support and having a central hole for passing the logs. Usually one feeding device is located on the upstream side of the support for feeding the logs into the machine, while another corresponding feeding device is located on the downstream side of the support for outputting the barked log. A number of pivotable machining tools are mounted to the rotor, the machining tools being equipped with replaceable elements that can be pressed against the surface of the log in order to peel off the bark.

Feeding devices for barking machines have the function of feeding the logs in a quick and powerful way without the logs slipping in the contact with the feed cylinders. The feed cylinders are for this purpose typically arranged with friction increasing elements, for instance in the form of projecting pins or the like, at the envelope surface thereof. The feed cylinders must by the same cause be distinctly pressed against the logs but at the same time indulgently follow irregularities in the surface of logs having varying dimensions.

It is customary that the feeding speed through a feeding device at barking machines is in the range of a couple of meters per second or more. It is thereby realized that the feed cylinders and the links are exposed to high dynamical loads and rapid adjustment movements when a log enters the feeding device and leaving the feeding device, respectively.

A feeding device of this kind in known from the applicants earlier Swedish Patent having publication number SE 517517 C2. Distinguishing for this feeding device is that a holding down mechanism in the form of a compressible bellows is arranged between the support and a link that is part of the link system. The bellows is arranged to be compressed and expanded depending on the pivoting movement of the feed cylinders and has the function to generate a holding down force that secure the vital contact between the feed cylinders and the envelope surface of the log. A shock absorber having the function of damping the movement of the feed cylinders in connection with the log leaving the feed cylinders is configured to work between the support and a link that is part of the link system.

In the known feeding device considerable dynamical loads in the form of shocks and vibrations are transferred to the support in connection with the log entering and leaving the feeding device, respectively. These shocks and vibrations cause a great strain on the holders of the shock absorber and on the support.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
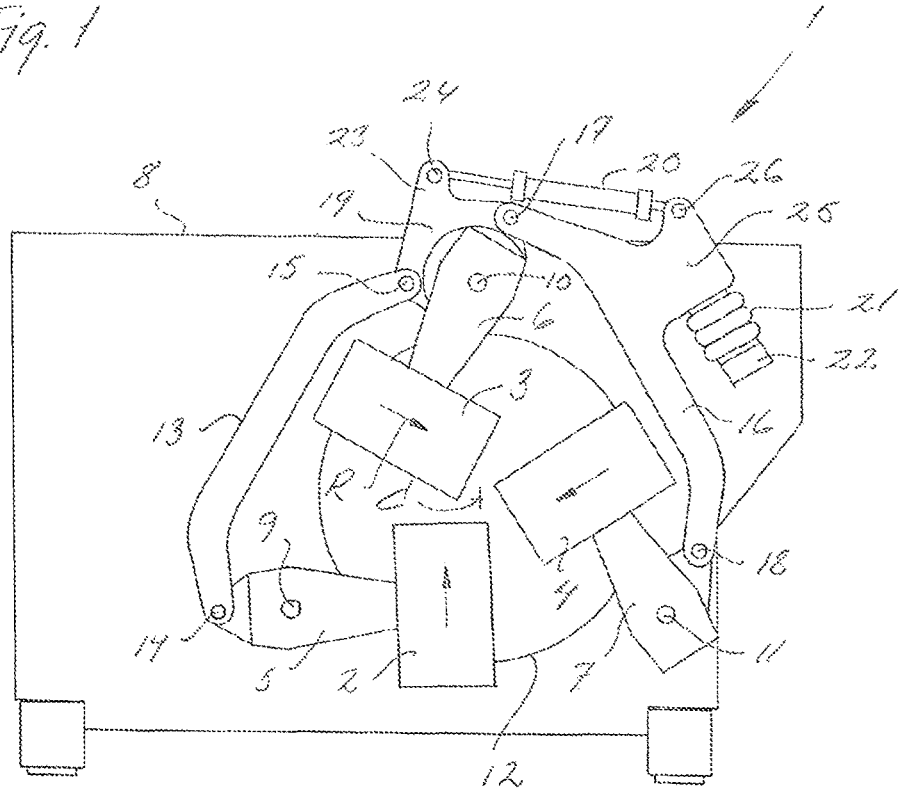
FIG. 1 is a schematic illustration of a feeding device in the home position seen from an input side or an output side.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

In exemplary embodiments, a computing device may be endowed with one or more components of the disclosed apparatuses and/or systems and may be employed to perform one or more methods as disclosed herein.

In various embodiments, one or more of the above mentioned disadvantages of the known feeding device may be reduced or obviated by providing that type of feeding device with a movement damping element (also referred to herein as a "motion damper") that is separate from the support, integrated into the link system, and independently from the support configured to brake the return movement of the supporting arms from a pivoted position. Thereby the risk of wear or fatigue caused by shocks and vibrations that otherwise are transferred to the support may be eliminated or reduced.

In various embodiments, a feeding device comprises a support having a through opening and feed cylinders adjoining the opening, which feed cylinders are angularly distributed and which are individually arranged in a free end of a respective supporting arm and driven in rotation, and wherein the supporting arms in a supported end are journalled in the support on shafts extending in parallel with each other and pivotable about the shafts between a home position and a pivoted work position, and wherein the supporting arms are mutually connected to each other via a system of articulated links and by means of the links forced to pivot jointly about their respective shafts. The system of links comprises bar-shaped links that are connected between the supporting arms, which links in each end are articulately connected to a respective supporting arm, as well as a carrier that is inserted between the links and articulately connected in relation to the links. In one embodiment the movement damping element is operatively connected between the carrier and one of said two links.

For this purpose the link in question presents a bracket that is directed outwards as seen from the feeding path and serving as a first holder for the movement damping element. According to the same embodiment the carrier can take the shape of a bracket that is directed outwards as seen from the feeding path and acting as a moment arm pivoting together with the supporting arm and serving as a second holder for the movement damping element.

In some embodiments of the feeding device there is arranged a holding down element (also referred to herein as an "actuator") operative to generate a holding down force by which the feed cylinders are pressed against the surface of the feeding log. This holding down element may for instance be realized in the form of a resilient bellows, such as an air filled bellows, arranged to operate between the system of links and the support.

In various embodiments, a holding down element in the form of a mechanical spring, a gas spring or a hydraulic spring is integrated in the movement damping element.

Figure 2:
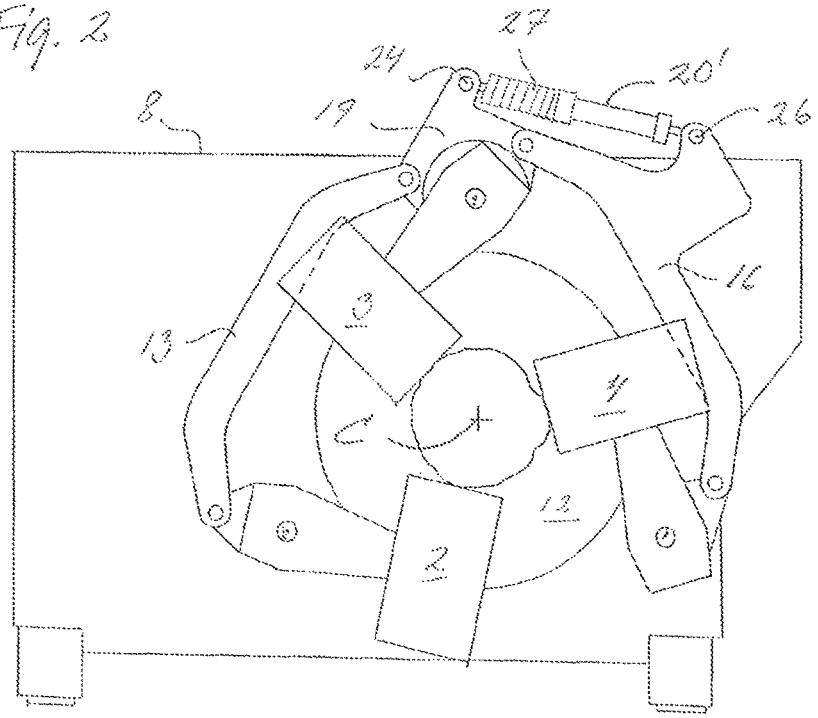
FIG. 2 is a corresponding view disclosing a partly modified feeding device in operational mode.

Referring now to FIGS. 1-2, a feeding device 1 for feeding a log in the length direction of the log usually comprises three feed cylinders 2, 3 and 4 which are supported in the free end of a respective supporting arm 5, 6 and 7 which in a supported end are pivotably journalled in a machine support/stand 8. The supporting arms are journalled on shafts 9, 10 and 11 which extend in parallel to each other and essentially in the feeding direction of the log through the feeding device. The shafts 9-11 are evenly distributed angularly about an opening 12 through the support, and may by other words be said to be located at the tips of an isosceles triangle. The feed cylinders 2-4 are driven in rotation R in order to, by means of the envelope surfaces thereof being in tangential contact with a log, feeding the log through the opening 12. An imaginary feeding path through the feeding device is defined in this way by means of the feed cylinders and their envelope surfaces that are tangentially oriented in relation to the feeding path. The letter C in the drawings stand for a centre of the feeding path.

The feed cylinders may via a chain and gear drive transmission be jointly driven by an individual driving device, but may alternatively be individually driven by separate driving devices that are arranged in the respective supporting arm or feed cylinder.

Supporting arms and corresponding feed cylinders are mutually connected via a system of links that are articulately connected to the supporting arms 5-7. The link system comprises more precisely a first link 13 that is pivotably journalled about pivots 14 and 15 arranged at the supporting arms 5 and 6, respectively. A second link 16 is in the corresponding way pivotably journalled about pivots 17 and 18 arranged at the supporting arms 6 and 7, respectively. The links 13 and 16 are mainly bar-shaped and may present bendings in order to admit that the feed cylinders are pivoted outwards in overlapping relationship with the links 13 and 16 (as illustrated in FIG. 2). A third link 19 is pivotably journalled about pivots 15 and 17 in relation to the links 13 and 16. The third link 19 acts as a carrier for a movement damping element 20 in a way that will be described in more detail below.

The supporting arms and the feed cylinders of the feeding device are freely pivotable about their respective shafts 9-11 and may by means of the location of the pivots 14-15 and 17-18 on the supporting arms and in relation to the fulcrum of the shafts 9-11 be balanced such that no significant turning forces normally effects the feeding device in its home position. In order to secure the necessary engagement of the feed cylinders with the outside of the log a holding down force is applied to the link system, which force in the embodiment according to FIG. 1 is generated by means of a spring element 21. The spring element 21 may as is shown in FIG. 1 be supported by a bracket 22 arranged on the support in order to act between the support 8 and a link 16 that is part of the system of links. The spring element 21 may be constituted by a known gas filled bellows or by a so-called air spring.

Thus far, the described feeding device 1 essentially corresponds to the feeding device known from SE 517517 C2.

The feeding device 1 is distinguished from the known feeding device in an essential way, and more precisely by means of the arrangement of the movement damping element 20 in the feeding device.

The design of the movement damping device 20 may be of the known type that comprises a piston that is axially displaceable in a cylinder and that divide the cylinder in a first and a second chamber, both filled with hydraulic liquid. The chambers communicates with each other via a return check valve that admit in principle an unhindered flow from one chamber to the other and that by means of a flow restricting choke brakes the return flow for a more slow movement of the piston in the return direction. The movement damping element 20 acts in this way to dampen the movement of the feed cylinders in connection with a log leaving the feeding device while the supporting arms and feed cylinders pivot back to the home position before the next log arrives at the feeding device.

The movement damping element 20 is in the feeding device 1 arranged integrated in the link system and thus independently from the support operative to brake the return movement of the supporting arms to the home position according to FIG. 1, from the work position according to FIG. 2, wherein the supporting arms are pivoted outwards from the centre C of the feeding path in radial directions. For this function the movement damping element 20 is in one end thereof articulately journalled in a bracket 23 configured on the carrier 19 and serving as a first attachment point 24 for the movement damping element. In the opposite end the movement damping element 20 is articulately journalled in a bracket 25 configured on the second link 16 and serving as a second attachment point 26 for the movement damping element. Arranged in this way the movement damping element 20 is only activated/compressed as a result of the mutual pivoting movement of the links. More precisely the movement damping element 20 is activated or "charged" by means of reduction of the distance between the attachment points 24 and 26 as a result of the mutual turning of the carrier 19 and the link 16 in opposite turning directions about the pivot 17, during outwards pivoting of the supporting arms. In the corresponding way the braking force is internally adopted in the link system during extension of the distance between the attachment points 24 and 26 as a result of the mutual turning of the carrier 19 and the link 16 in inverted directions.

A modified embodiment of the above described feeding device is illustrated in FIG. 2. In this embodiment the spring element 21 has been deleted and is exchanged by a spring 27 that is merged with the movement damping element 20'. In general meaning the movement damping element 20' can be compared to a spring leg having a spring and a shock absorber in combination. The spring 27 may be constituted by a mechanical spring such as a coil spring, but may alternatively be constituted by an air spring or a spring filled with another compressible gas. In the modified embodiment the spring element that provides the necessary holding down force against the surface of the log is configured to act between the link 16 and the carrier 19, and is in other words like the movement damping element 20, 20' integrated in the link system.

Figure 3:
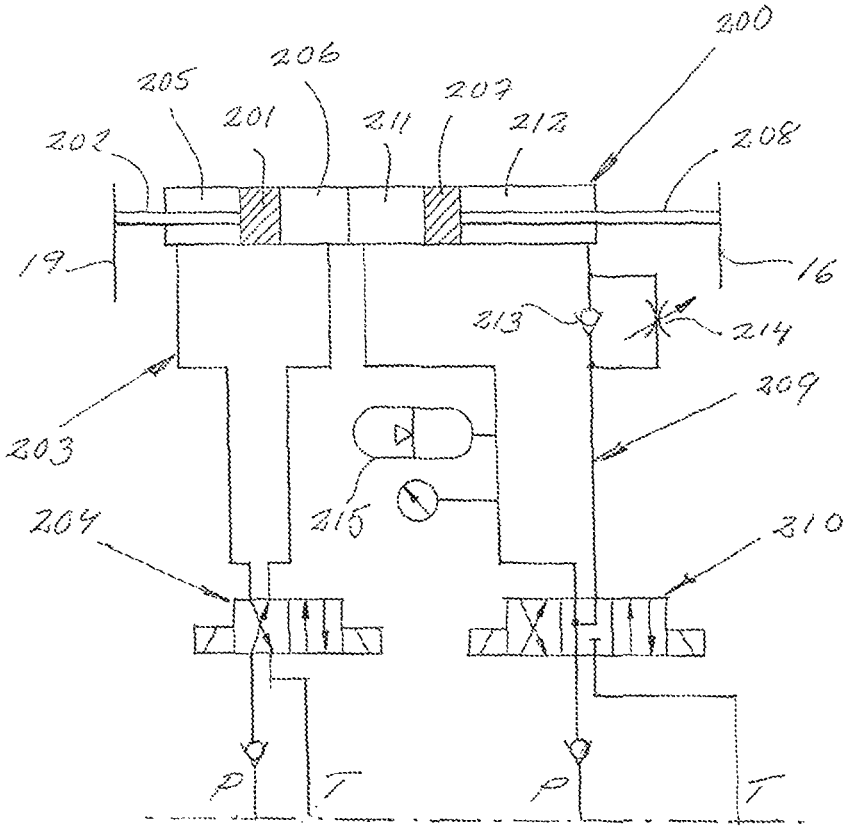
FIG. 3 illustrates part of the hydraulics of a feeding device, all in accordance with various embodiments.

An advantageous embodiment, the combined spring and movement damping element 20, 20' comprises a double cylinder 200 that is schematically disclosed together with the accompanying hydraulic in FIG. 3. The double cylinder 200 is in the corresponding way as the movement damping element 20 and 20' integrated in the link system of the feeding device, and may like these be arranged to act between the link 16 and the carrier 19.

The double cylinder 200 comprises a piston 201 having a piston rod 202 that is adjustable for adjusting the total length of the double cylinder and the distance between the link 16 and carrier 19 in this embodiment. For this function the piston 201 is served by a hydraulic circuit 203 that via a valve 204 regulates the volume of the two communicating cylinder chambers 205 and 206 which are separated by the piston 201 that is axially moveable in the double cylinder. Hereby the size of the opening between the feed cylinders 2-4 can be set to a home position or pre-opening position that is adapted to the thickness of the logs in question.

The double cylinder 200 thereto comprises a piston 207 having a piston rod 209 that presents the double functions of on the one hand dampen the return movement of the feed cylinders to the home position when a log leaves the feeding device, and on the other hand applying a holding down force that increase the contact pressure of the feed cylinders against the log during feeding through the feeding device. For this function the piston 207 is served by a hydraulic circuit 209 that via a valve 210 distribute the hydraulic liquid amongst the two communicating cylinder chambers 211 and 212 which are separated by the piston 207 that is axially moveable in the double cylinder. More precisely, the hydraulic circuit 209 comprises a non-return valve 213 that admit hydraulic liquid to unhindered flow from the chamber 211 to the chamber 212 via the valve 210 when the piston 207 moves in the direction from right to left in the drawings, as a result of the feed cylinders are pivoted outwards by the log entering between the feed cylinders. When the log leaves the feeding device and the feed cylinders are pivoted back, the piston 207 moves in the opposite direction, the hydraulic liquid pass back from the chamber 212 to the chamber 211 via the adjustable choking 214. Thereby the flow is braked and the movement of the feed cylinders is damped.

An accumulator 215 is connected in order to raise the working pressure in the hydraulic circuit 209 and applies a pressure that acts against the greater piston area of the piston 207 that is thereby biased in the direction from left to right in the drawings. Hereby the double cylinder 200 exercises a holding down force to the link system and to the feed cylinders 2-4. The size of the accumulator pressure may as an example be set to ca 3-3.8 MPa, the higher pressure being applied on the feeding side of the feeding device. The pressure range may vary among embodiments, and may be wider, narrower, higher, or lower than in the above example. For completeness it shall be mentioned that the letter references P and T refer to connection conduits from a pump and to a tank, respectively. Other components that are needed for hydraulic medium supply and safety systems are left out from the drawings because their arrangement is not crucial and thus need not be described in further detail.

In this context it shall be mentioned that the double cylinder 200 in an eminent way may be maneuvered to open the feeding device in connection with service. By corresponding setting of the valves 204 and 210 both pistons 201 and 207 may when needed be displaced to their outer end positions for maximum turning outwards of the feed cylinders 2-4, in order to offer the best possible access during service of the feeding device.

In general, a feeding device in accordance with embodiments described herein may comprise a support (8) having feed cylinders (2,3,4) arranged in a free end of a respective supporting arm (5,6,7) and driven in rotation, wherein the supporting arms in a supported end are journalled in the support on shafts (9,10,11) extending in parallel with each other and pivotable about the shafts between a home position and a pivoted work position, and wherein the supporting arms are mutually connected to each other via a system of articulated links (13,16,19) and by means of the links forced to pivot jointly about their respective shafts, and a movement damping element (20,20',200), which is separate from the support, may be integrated in the system of links and independently from the support configured to brake the return movement of the supporting arms from the pivoted position.

Alternatively, in other embodiments the movement damping element may instead be mounted to act between the carrier 19 and the first link 13. Where appropriate the flow regulating valve may be realized having inverted function and configured to cause a braking of the movement of the link system during compression of the piston/cylinder unit.

In both embodiments the object to remove or essentially reduce the disadvantages of wear and fatigue caused by shocks or vibrations transferred to the support may be fulfilled.

Embodiments of a method for modifying a feeding device of the known type may include providing the feeding device with a motion damping element (a 'motion damper') as described herein by pivotably coupling opposite ends of the motion damping element to corresponding portions (e.g., bracket portions 23, 25) of two of the links (e.g., carrier 19 and second link 16). The method may further include providing a holding down element between the support and one of the links, or between two of the links (e.g., between carrier 19 and second link 16). Again, in some embodiments, the holding down element and the motion damping element may be integrated within a single device as described above and illustrated, for example, in FIGS. 2-3.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. An axial feed system for logs, comprising:

a support having a through opening;

a plurality of supporting arms pivotably mounted to the support on corresponding shafts such that the supporting arms are pivotable between a home position and a work position, wherein the supporting arms are configured to support corresponding rotatable feed cylinders in an angular distribution around a center axis of the through opening;

a plurality of links pivotably coupled with the supporting arms, and with each other, such that the links are collectively operable to force the supporting arms to pivot jointly about the corresponding shafts, wherein the plurality of links includes a first link and a second link, and the first and second links are pivotable about a first pivot axis that extends through a first portion of the first link and a first portion of the second link; and a motion damper with opposite first and second ends, the first end pivotably attached to the first link at a second portion of the first link and the second end pivotably attached to the second link at a second portion of the second link, such that the second portions of the first and second links are connected by the motion damper, wherein the motion damper is configured to brake return movement of the supporting arms to the home position.

2. The feeding device of claim 1, wherein the plurality of links further includes a third link, and wherein the first and third links are disposed on opposite sides of the through opening and pivotably coupled to the second link.

3. The feeding device of claim 2, wherein the motion damper includes a cylinder and a piston that divides the cylinder into a first and a second chamber, the chambers are in fluid communication, and the motion damper is operable to allow fluid to flow substantially unhindered from the first chamber as the supporting arms are moved from the home position to the work position and to restrict a return flow of the fluid from the second chamber to thereby brake the return movement of the supporting arms to the home position.

4. The feeding device of claim 3, wherein each of the second portions is a bracket portion that is directed outwardly away from the center axis, and wherein the ends of the motion damper are pivotably attached to the first and second links at the bracket portions, and wherein the cylinder is a hydraulic cylinder and the chambers are in fluid communication through a check valve that allows the fluid to flow substantially unhindered from the first chamber to the second chamber and an adjustable choke that restricts the return flow of the fluid from the second chamber to the first chamber.

5. The feeding device of claim 2, further including an actuator coupled with one of the links, wherein the actuator is actuable to apply force against the corresponding link to thereby press the feed rolls against a log within the through opening.

6. The feeding device of claim 5, wherein the actuator is attached to the support and to the corresponding link, such that the actuator is arranged to act between the corresponding link and the support.

7. The feeding device of claim 6, wherein the actuator includes a bellows, a mechanical spring, a gas spring, or a hydraulic spring.

8. The feeding device of claim 5, wherein the actuator is integrated with the motion damper.

9. The feeding device of claim 8, wherein the actuator includes a mechanical spring, a gas spring, or a hydraulic spring, and the motion damper includes a hydraulic cylinder with a piston.

10. The feeding device of claim 1, wherein the motion damper includes a double cylinder with first and second cylinder portions, each of the cylinder portions having a respective piston with a respective piston rod, and wherein the first and second cylinder portion includes the first end of the motion damper and the second cylinder portion includes the second end of the motion damper.

11. The feeding device of claim 10, wherein the first cylinder portion is operable to apply force against the corresponding links to thereby adjust a distance between the feed cylinders, and the second cylinder portion is operable to brake the return movement of the supporting arms to the home position.

12. The feeding device of claim 11, wherein the second cylinder portion is further operable to increase a contact pressure of the feed cylinders against a log within the through opening.

13. The feeding device of claim 10, wherein the double cylinder is a double hydraulic cylinder, and the second cylinder portion further includes a hydraulic circuit with one or more of a non-return valve, an adjustable choke, or an accumulator.

14. A feeding device for feeding a log axially in a flow direction, comprising:

a support having a through opening and feed cylinders adjoining the opening, wherein the feed cylinders are angularly distributed and individually arranged in a free end of a respective supporting arm and driven in rotation, and wherein the supporting arms in a supported end are journalled in the support on corresponding shafts extending in parallel with each other, and the supporting arms are pivotable about the shafts between a home position and a pivoted work position, and wherein the supporting arms are mutually connected to each other via a system of articulated links and by means of the links forced to pivot jointly about their respective shafts, wherein the links include a first link and a second link, and the first and second links are pivotable about a first pivot axis that extends through a first portion of the first link and a first portion of the second link; and a movement damping element configured to brake the return movement of the supporting arms to the home positions, wherein the motion damper has opposite first and second ends, the first end is pivotably attached to the first link at a second portion of the first link and the second end is pivotably attached to the second link at a second portion of the second link, such that the second portions of the first and second links are connected by the motion damper.

15. The feeding device of claim 14, wherein the movement damping element is provided with a holding down element operatively arranged between the links in the system of links to apply a holding down force to the feed cylinders.

16. The feeding device according to claim 14, wherein the system of links comprises elongated links that are articulately connected between the supporting arms and a carrier link that is inserted between the elongated links and articulately connected in relation to the elongated links, the first link is one of the elongated links, and the second link is the carrier link.

17. The feeding device according to claim 16, wherein the second portion of the first link is a bracket portion serving as a holder for the movement damping element.

18. The feeding device according to claim 17, wherein the second portion of the second link is another bracket portion serving as a moment arm pivoting together with the corresponding supporting arm, wherein the moment arm serves as another holder for the movement damping element.

19. The feeding device according to claim 14, wherein the movement damping element includes an integrated holding down element in the form of a spring.

20. The feeding device of claim 19, wherein the spring is a mechanical spring, a gas spring, or a hydraulic spring.

21. The feeding device according to claim 14, wherein the movement damping element includes a hydraulically driven double cylinder comprising a first piston that is effected by a hydraulic holding down element in the form of an accumulator.

22. The feeding device of claim 21, wherein the hydraulically driven double cylinder further comprises a second piston that is adjustable for setting a pre-opening position between the feed cylinders.

23. The feeding device according to claim 14, wherein the movement damping element includes a hydraulically driven double cylinder comprising a piston that is adjustable for setting a pre-opening position between the feed cylinders.

* * * * *